US009498993B2

(12) United States Patent
Kubozono et al.

(10) Patent No.: US 9,498,993 B2
(45) Date of Patent: Nov. 22, 2016

(54) IMAGE PROCESSING APPARATUS, IMAGE PROCESSING METHOD, AND MEDIUM STORING PROGRAM

(71) Applicant: CANON KABUSHIKI KAISHA, Tokyo (JP)

(72) Inventors: Kenji Kubozono, Kawasaki (JP); Shinsuke Ikegami, Tokyo (JP); Akira Kuronuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/814,378

(22) Filed: Jul. 30, 2015

(65) Prior Publication Data

US 2016/0031252 A1 Feb. 4, 2016

(30) Foreign Application Priority Data

Jul. 31, 2014 (JP) ..... 2014-157087

(51) Int. Cl.

| | |
|---|---|
| ***B41J 2/165*** | (2006.01) |
| ***B41J 29/393*** | (2006.01) |
| *B41J 2/21* | (2006.01) |
| *B41J 2/045* | (2006.01) |

(52) U.S. Cl.

CPC ..... *B41J 29/393* (2013.01); *B41J 2/16579* (2013.01); *B41J 2/2142* (2013.01); *B41J 2/2146* (2013.01); *B41J 2/0451* (2013.01); *B41J 2/2132* (2013.01); *B41J 2/2139* (2013.01)

(58) Field of Classification Search

CPC .. B41J 2/0458; B41J 2/04563; B41J 29/393; B41J 2/04591; B41J 2/04581; B41J 2/16579; B41J 2/2142; B41J 2/2146; B41J 2/0451; B41J 2/2139; B41J 2/2132

USPC ..... 347/14

See application file for complete search history.

(56) References Cited

U.S. PATENT DOCUMENTS

| | | | | |
|---|---|---|---|---|
| 2004/0141209 | A1* | 7/2004 | Marumoto | H04N 1/4078 358/3.26 |
| 2009/0160125 | A1* | 6/2009 | Fujita | B65H 5/38 271/227 |
| 2010/0253982 | A1 | 10/2010 | Kasai et al. | |
| 2011/0261417 | A1* | 10/2011 | Akahane | H04N 1/4076 358/461 |
| 2013/0182052 | A1 | 7/2013 | Matsuzaki et al. | |

FOREIGN PATENT DOCUMENTS

JP 2003244469 A 8/2003

OTHER PUBLICATIONS

Office Action for U.S. Appl. No. 14/806,443, Jan. 13, 2016.

* cited by examiner

*Primary Examiner* — Manish S Shah
*Assistant Examiner* — Yaovi M Ameh
(74) *Attorney, Agent, or Firm* — Canon U.S.A., Inc. IP Division

(57) ABSTRACT

Judgment image data having a resolution in a direction in which a printing medium is conveyed which is lower than a printing resolution is generated based on input image data. It is determined whether color unevenness is generated in a printed image by comparing the judgment image data with reading data obtained by reading the printed image.

16 Claims, 14 Drawing Sheets

IMAGE PROCESSING APPARATUS, IMAGE PROCESSING METHOD, AND MEDIUM STORING PROGRAM

BACKGROUND OF THE INVENTION

Field of the Invention

The present disclosure relates to an image processing apparatus for inspecting a printed subject printed by a printing apparatus, an image processing method, and a medium storing a program.

Description of the Related Art

In general, a method for determining whether a color deviation has occurred using reading data obtained by reading a printed image has been used as a method for inspecting an image printed by a printing apparatus.

Japanese Patent Laid-Open No. 2003-244469 discloses a method for extracting a monochrome region utilizing saturation of image data and determining whether a color deviation has occurred in an image read by a scanner or the like in accordance with the correlation of saturation or color as a method for detecting random color unevenness included in a printed image.

However, when the method disclosed in Japanese Patent Laid-Open No. 2003-244469 is used, a large processing load is applied and a long period of time is required for a process of detecting a color deviation depending on a resolution used in the process of detecting a color deviation in an image.

SUMMARY OF THE INVENTION

The present disclosure provides an image processing apparatus which inspects an image printed, by printing heads having a plurality of nozzles which eject ink and which are arranged in a first direction, on a printing medium which is conveyed in a second direction which intersects with the first direction. The image processing apparatus includes a generation unit configured to generate judgment image data, used for inspection of printed image printed with a first resolution in the second direction, the judgment image data having a second resolution in the second direction which is lower than the first resolution, based on data on the image, and an inspecting unit configured to inspect the image by comparing, with the second resolution, the judgment image data with reading data obtained by reading the image printed with the first resolution in the second direction based on the data on the image.

Further features of the present invention will become apparent from the following description of exemplary embodiments with reference to the attached drawings.

DESCRIPTION OF THE EMBODIMENTS

First Embodiment

Inkjet Printing Apparatus and Image Pickup Sensor

Figure 1A:
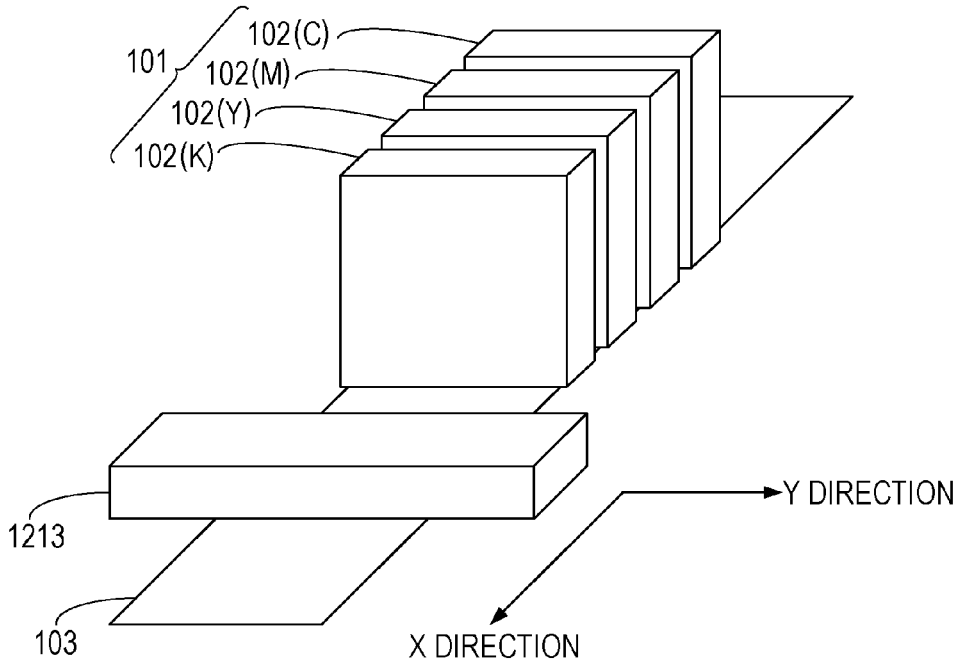
FIGS. 1A and 1B are diagrams schematically illustrating printing heads, an image pickup sensor, and a printing medium.
Figure 1B:
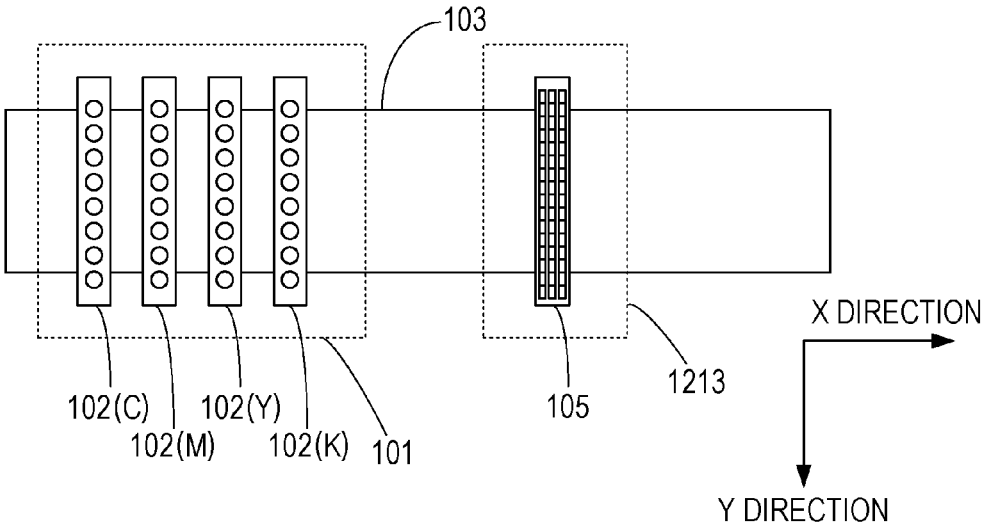

FIGS. 1A and 1B are diagrams schematically illustrating a plurality of printing heads 102 in a printing unit 101, an image reading unit 1213, and a printing medium 103. Specifically, FIG. 1A is a perspective view of the printing heads 102, the printing medium 103, and the image reading unit 1213, and FIG. 1B is a plan view of the printing heads 102, the printing medium 103, and the image reading unit 1213 viewed from an ejection port surface having nozzles (ejection ports) of the printing heads 102 formed thereon.

In this embodiment, an inkjet printer which prints an image by ejecting ink from nozzles formed on printing heads will be described as an example. The printer of this embodiment uses rolled continuous form paper as a printing medium. The printer of this embodiment is a high-speed line printer which may perform one-side printing and both-side printing and is suitable for a field of mass printing in print laboratories and the like.

The printing unit 101 forms an image on the printing medium 103 using the printing heads 102. The printing heads 102 include nozzle arrays formed thereon. Each of the nozzle arrays include a plurality of nozzles arranged in a Y direction in FIGS. 1A and 1B. An image is printed on the printing medium conveyed in an X direction which intersects with the Y direction in FIGS. 1A and 1B by ejecting ink droplets from the nozzles. The printing heads 102 may print an image by one conveying operation on a printing medium having a maximum width in the Y direction among printing media expected to be used. Note that, in this embodiment, the printing unit 101 is capable of ejecting inks of a plurality of colors, and the plurality of printing heads 102 corresponding to the respective colors are arranged in the X direction in FIGS. 1A and 1B. The plurality of printing heads 102 include a printing head 102(C) for a cyan ink, a printing head 102(M) for a magenta ink, a printing head 102(Y) for a yellow ink, and a printing head 102(K) for a black ink. In this embodiment, heating elements are used as printing elements, and a so-called thermal inkjet system which ejects ink by heating the heating elements is employed.

The number of ink colors is not limited to four, that is, cyan, magenta, yellow, and black, and the number of printing heads is also not limited to four. Furthermore, a printing method to which the present disclosure is applicable is not limited to the thermal inkjet system, and a system using piezoelectric elements, a system using electrostatic elements, a system using MEMS elements, or the like may be employed.

The image reading unit 1213 optically reads an image and an examination pattern printed by the printing heads 102 on the printing medium 103 using a sensor 105, such as a scanner or a camera. The image reading unit 1213 is used to inspect ejection states of the nozzles of the printing heads 102, a conveying state of the printing medium, a position of the image, and the like.

Figure 2:
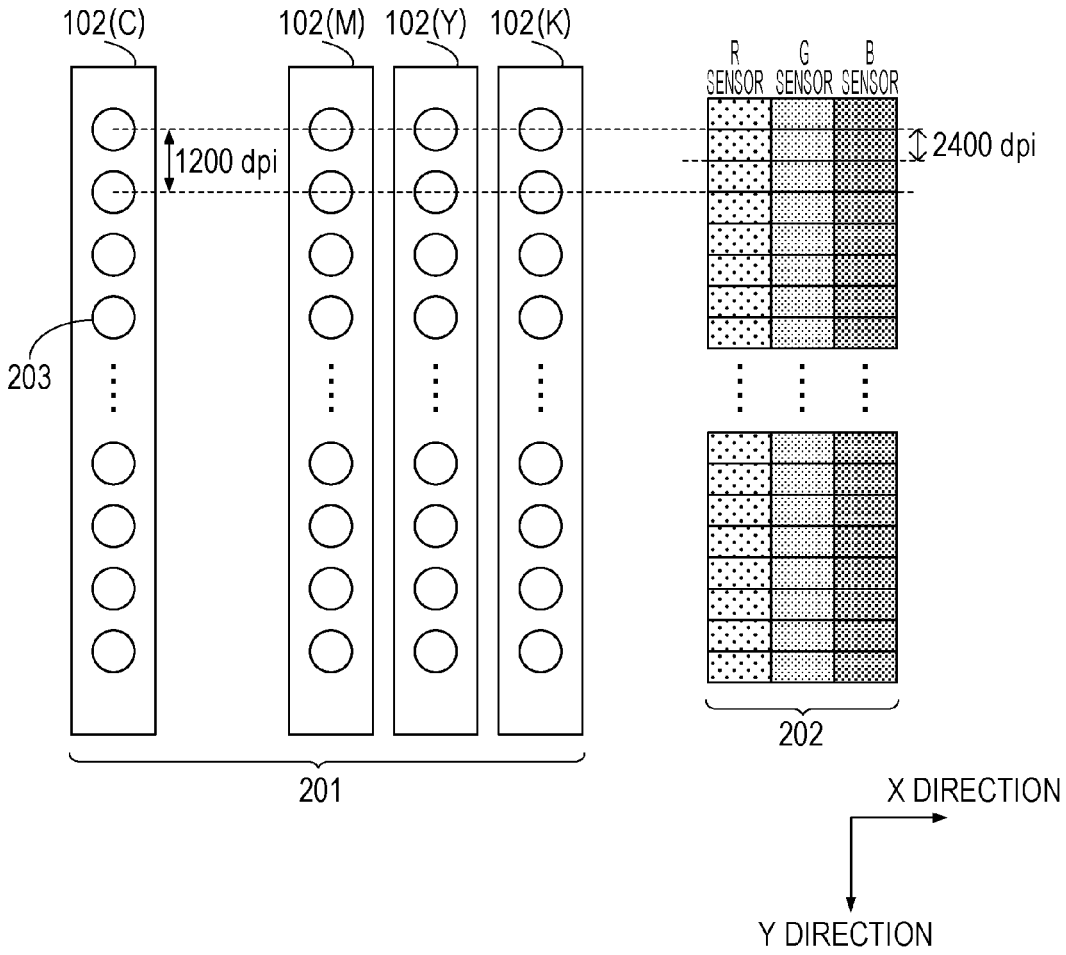
FIG. 2 is a diagram illustrating arrangement of nozzles of the printing heads and arrangement of photodiodes of sensors.

FIG. 2 is a diagram illustrating the correlation between the arrangement of the nozzles of the printing heads 102 and the sensor 105 illustrated in FIG. 1B. A reference numeral 201 denotes the arrangement of the nozzles which are formed on the printing heads 102 and which are arranged in a predetermined array pitch. In a case where 1200 nozzles are arranged per 1 inch, that is, 1 nozzle corresponds to 1 dot, nozzles 203 are arranged in the Y direction with a nozzle resolution of 1200 dpi. A reference numeral 202 denotes the sensor 105. According to the Nyquist theorem, when a certain signal is to be sampled, a resolution which is twice as much as a sampling resolution is required, and therefore, when processing is performed in a unit of nozzle, photodiodes of R, G, and B are required to be arranged at an interval of 2400 dpi as reading elements. Accordingly, in this embodiment, the sensor 105 including photodiodes arranged such that 2400 photodiodes are arranged per inch, that is, photodiodes are arranged at an interval of 2400 dpi in the Y direction corresponding to a nozzle arrangement direction, is used. The sensor 105 is capable of reading an image and an examination pattern printed on the printing medium with a resolution of 2400 dpi, and in addition, is capable of performing the reading with a lower resolution.

System Configuration

Figure 13:
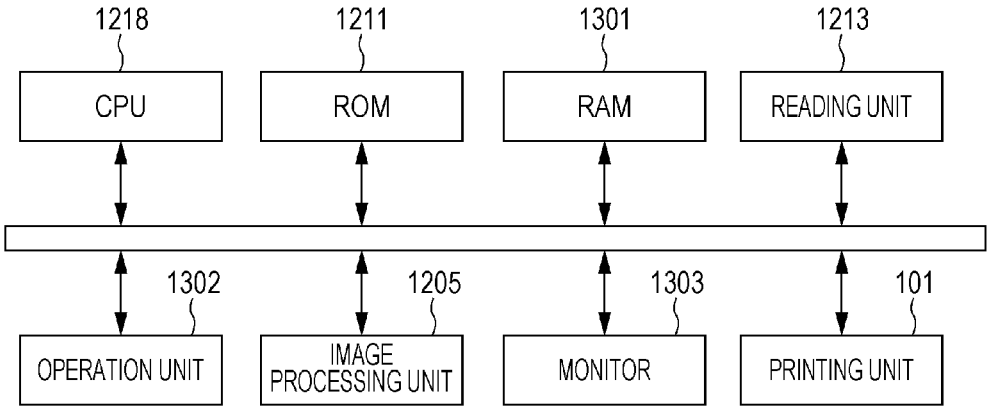
FIG. 13 is a diagram illustrating a system configuration.

FIG. 13 is a block diagram illustrating a configuration of the image processing apparatus according to this embodiment. The image processing apparatus of this embodiment is realized when a host computer executes a program. A CPU 1218 performs various control operations on a RAM 1301, an operation unit 1302, an image processing unit 1205, a monitor 1303, a reading unit 1213, and the printing unit 101 in accordance with information data and various programs stored in a ROM 1211. Examples of the programs stored in the ROM 1211 include a control program, an OS (Operating System), an application program, a color conversion processing module, and a device driver. The ROM 1211 constituted by a hard disk or a nonvolatile memory is a storage unit which stores information and data described below to be read. The reading unit 1213 processes a signal read by the sensor 105. When the CPU 1218 operates, the RAM 1301 is used as a work area and a temporary save area for the various control programs and data input by the operation unit 1302. A DRAM 1204 described below is also included in the RAM 1301.

Figure 12:
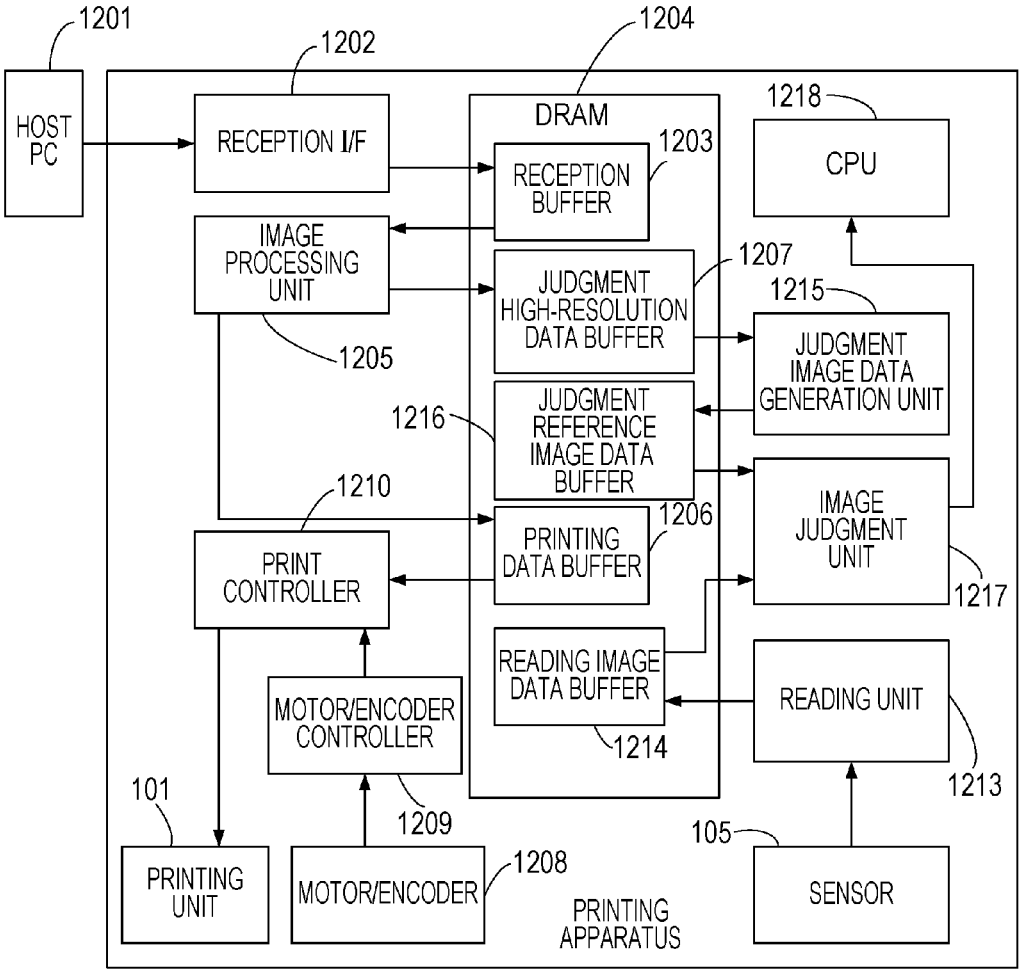
FIG. 12 is a diagram illustrating a configuration of an entire system.

FIG. 12 is a diagram illustrating a configuration of an entire system and a control flow according to this embodiment. The control flow of this embodiment is performed when the CPU 1218 reads a program stored in the ROM 1211. An image process performed here will be described later in detail with reference to FIG. 6. A reception buffer 1203 included in a body of a printing apparatus receives input image data to be printed which is supplied from a host PC 1201 through a reception I/F 1202. The image processing unit 1205 reads the input image data from the reception buffer 1203 and performs a process illustrated in FIG. 6 until a quantization process in step S603 described below is reached. Thereafter, quantized image data is stored in a printing data buffer 1206. Furthermore, the image processing unit 1205 performs generation of judgment high-resolution image data for inspection of printed image (hereinafter referred to as "judgment high-resolution image data") in parallel to the image process performed on the input image data, and stores the judgment high-resolution image data in a judgment high-resolution image data buffer 1207.

A judgment image data generation unit 1215 reads the judgment high-resolution image data from the judgment high-resolution image data buffer 1207 and performs a resolution lowering process on the read data so as to generate judgment reference image data for inspection (hereinafter referred to as judgment reference image data"). Although described in detail hereinafter, the judgment image data generation unit 1215 generates judgment reference image data having a resolution in a conveying direction (X direction) of the printing medium lower than a printing resolution of an image. Thereafter, the generated judgment reference image data is stored in a judgment reference image data buffer 1216. A print controller 1210 generates printing data representing ejection or non-ejection of ink in response to a print timing signal which is generated by a motor/encoder 1208 and which is input from a motor/encoder controller 1209. The print controller 1210 transmits the printing data to the printing unit 101 so that an image is printed on the printing medium.

The reading unit 1213 processes a sensor signal obtained by reading the printed image by the sensor 105 and stores the sensor signal in a reading image data buffer 1214 as reading data. An image unit 1217 reads the judgment reference image data stored in the judgment reference image data buffer 1216 and the reading data stored in the reading image data buffer 1214 and compares them with each other. Thereafter, the image judgment unit 1217 determines whether color unevenness is included in the printed image in accordance with a result of the comparison and transmits a result of the judgment to the CPU 1218.

Note that the reception buffer 1203, the judgment high-resolution image data buffer 1207, the judgment reference image data buffer 1216, the printing data buffer 1206, and the reading image data buffer 1214 are part of a main memory, such as the DRAM 1204 in this system. However, not only the DRAM, but also other memories, such as an SRAM, may be employed as long as the memory belongs to definition of a RAM.

Head Shading Process

Figure 3:
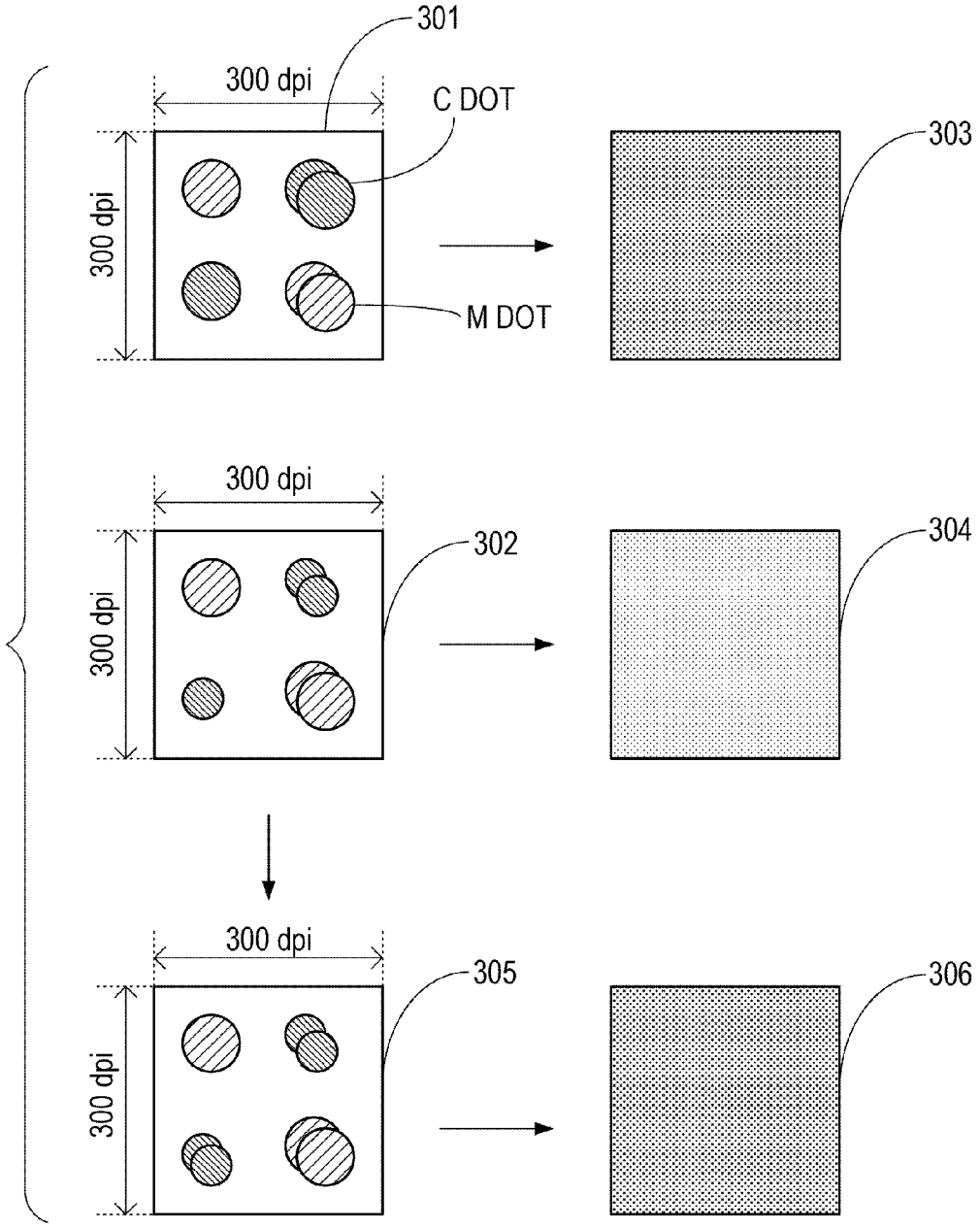
FIG. 3 is a diagram illustrating a concept of head shading.
Figure 4:
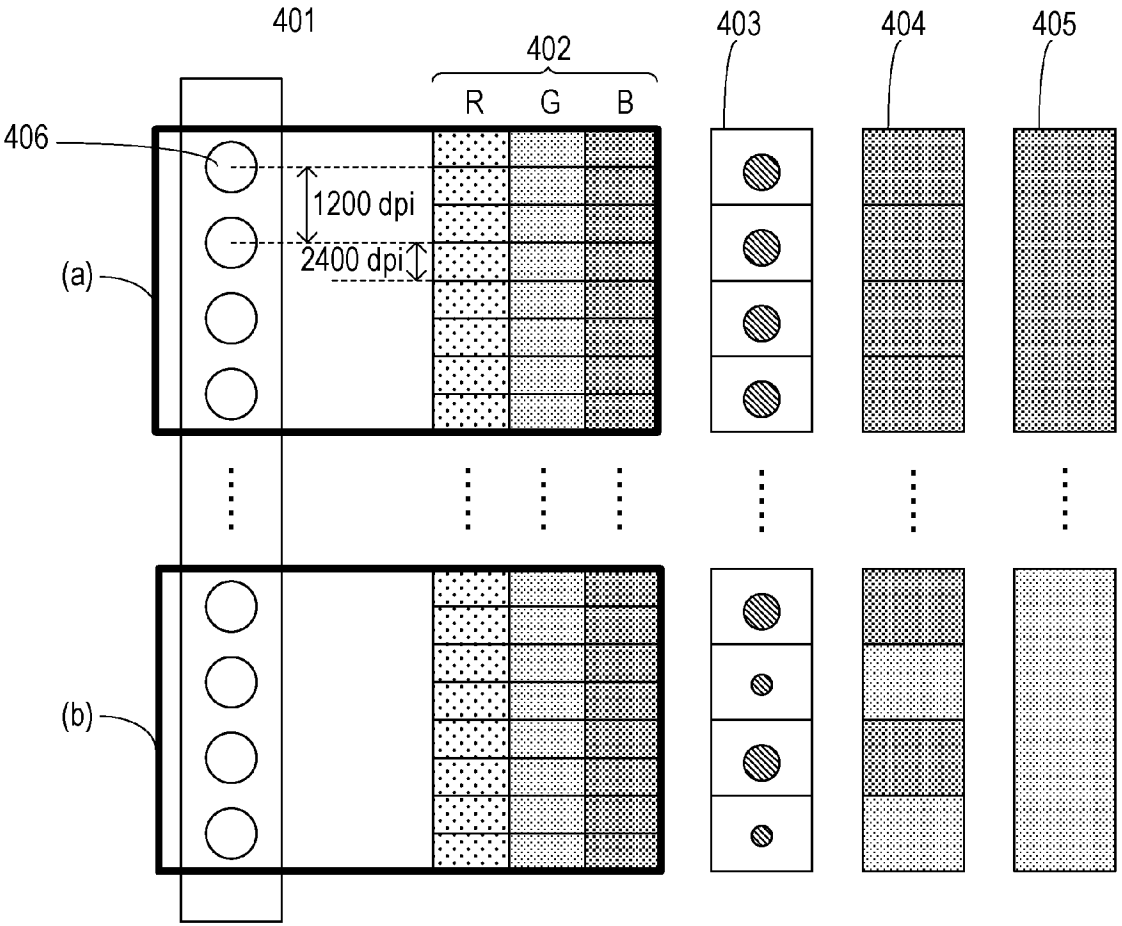
FIG. 4 is a diagram illustrating a unit of correction of the head shading.

FIGS. 3 and 4 are diagrams illustrating a concept of a head shading process (HS process). A case where a blue image is printed will be described as an example with reference to FIG. 3. A dot arrangement 301, which is a reference, has three cyan (C) dots and three magenta (M) dots arranged in a unit region of 300 dpi×300 dpi. A blue image 303 is printed by a reference amount of ejection of cyan dots and a reference amount of ejection of magenta dots. Note that the nozzles disposed on the printing heads 102 have manufacturing variations, and accordingly, amounts of ejection of ink droplets vary. In a case where an ejection amount of the cyan nozzle is smaller than the reference amount as represented by a dot arrangement 302, even when ink droplets corresponding to 3 dots are applied similarly to the dot arrangement 301, an amount of cyan ink applied to the unit region is small. As a result, color of a printed image 304 is reddish blue which is different from the blue image 303 printed by the reference amount. When an ejection amount varies in this way, even if values of input image data are the same, color differences are generated in individual unit regions arranged in a nozzle arrangement direction in the image printed on the printing medium, and color unevenness is generated as streaks continuously arranged in a direction in which the printing medium is conveyed.

To address the color differences caused by the variation of ejection amounts, an HS processing unit 707 described below performs a correction process on image data to be printed. In this embodiment, the number of cyan dots is increased from 3 dots to 4 dots as denoted by a dot arrangement 305 of FIG. 3. By this, a color of an image 306 printed in accordance with the image data which has been subjected to the correction process in the head shading becomes a color the same as that of the image 303 printed by the reference amount. In this way, color differences among a plurality of unit regions may be reduced by performing the correction for controlling the numbers of dots for individual unit regions.

Next, a process of generating a correction parameter used in the correction process will be described with reference to FIG. 4. First, a maintenance pattern for measuring an ejection amount is printed using a corresponding one of the printing heads 102. The pattern is printed by nozzles 406 of the printing heads 102 included in a portion (a) and a portion (b) of a nozzle array 401 and a plurality of nozzles in other portions. Such patterns are printed as single color patterns for individual ink colors of cyan, magenta, yellow, and black. The patterns are read by photodiode sensors of R, G, and B of a sensor 402, and a result of the reading is obtained. A reference numeral 403 denotes states of dots of the printed pattern. In the pattern printed by the portion (a) of the nozzle array, four dots have the same size. However, in the pattern printed by the portion (b), sizes of dots vary. Read data obtained by the reading is represented by density information 404 corresponding to the nozzles. Then a correction parameter representing an amount of increase or decrease of an ejection amount at a time of printing of a next image is generated in accordance with the reading data.

Although a correction parameter may be generated for each nozzle, a correction parameter is generally generated for a plurality of nozzles. This is because, although printers have nozzles arranged for high resolution of approximately 1200 dpi in recent years, a proper color may be sufficiently reproduced without correction by each nozzle in terms of image formation taking a size of a color unevenness portion visually recognized and a processing load into consideration. Accordingly, the correction process is performed on image data to be printed with an appropriate resolution in which color unevenness is not visually recognized in order to realize reduction of the processing load and realization of a high-speed process. In this embodiment, a correction table is generated with a resolution of 300 dpi, that is, in a unit of four nozzles, and feedback is performed to the image data. Therefore, as illustrated in FIG. 4, density information in the portion (a) of the nozzle array and density information in the portion (b) are averaged so that reading data having a resolution of 300 dpi is generated as denoted by a reference numeral 405, and correction is performed based on the reading data. In this way, the head shading process is performed in a unit of a plurality of nozzles while a correction parameter is changed in real time so that color unevenness in a printed image may be reduced and an image may be stably output.

Figure 6:
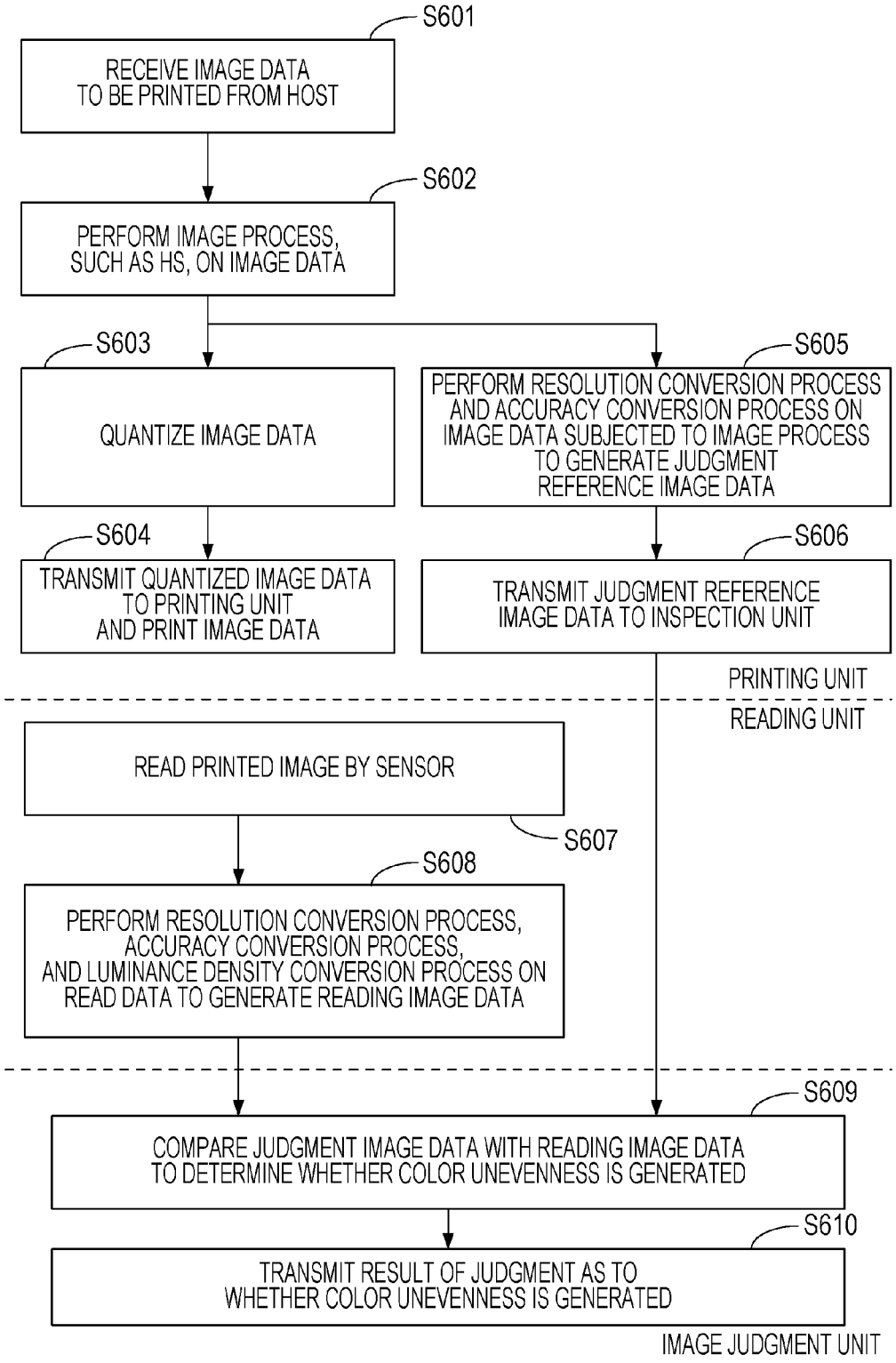
FIG. 6 is a diagram illustrating an entire flowchart.

FIG. 6 is a flowchart illustrating an entire control program according to this embodiment. This control program is stored in the ROM 1211 and is read and executed by the CPU 1218. In step S601, the printing apparatus receives input image data from a host PC 1201. In step S602, an image process is performed on the input image data using a correction parameter stored in advance. In step S603, a quantization process is performed on the data which has been subjected to the image process. The processes in step S602 and step S603 will be described hereinafter with reference to FIG. 7. In step S604, the quantized image data is transmitted to the printing unit 101 and an image is printed on the printing medium by ejecting ink dots in synchronization with a conveying speed of the printing medium.

On the other hand, in step S605, judgment reference image data is generated in parallel to the flow from step S602 to step S603. Resolution conversion (averaging) and accuracy conversion are performed based on the image data which has been subjected to the image process so that judgment reference image data is generated. These processes will be described hereinafter with reference to FIG. 8 and FIGS. 9A to 9C. In step S606, the generated judgment reference image data is transmitted to the image judgment unit 1217. The process of generating the judgment reference image data is not required to be performed in parallel to the image process on the input image data, and one of the process of generating the judgment reference image data and the image process on the input image data may be performed first.

In step S607, the reading unit 1213 reads the image printed on the printing medium when the printing medium passes the sensor 105. Although described in detail hereinafter, as for a reading resolution in reading of an image by the sensor 105, a reading resolution in the X direction is lower than a printing resolution for the image, that is, a resolution at a time when ink dots are ejected. In step S608, a resolution conversion process (averaging process), an accuracy conversion process, and a luminance density conversion process are performed on the read data so that reading image data is generated. Thereafter, the reading image data is transmitted to the image judgment unit 1217.

In step S609, the image judgment unit 1217 receives the judgment reference image data and the reading image data and compares the judgment reference image data with the reading image data so as to determine whether color unevenness is generated in the printed image. In step S610, a result of the judgment is supplied to the CPU 1218. By performing such a processing flow in a unit of image printed on the rolled continuous form paper, a unit of line, or a unit of rectangle, even color unevenness generated during consecutive printing of a plurality of images may be detected and a result of the detection may be informed.

Various Image Processes on Input Image Data

Figure 7:
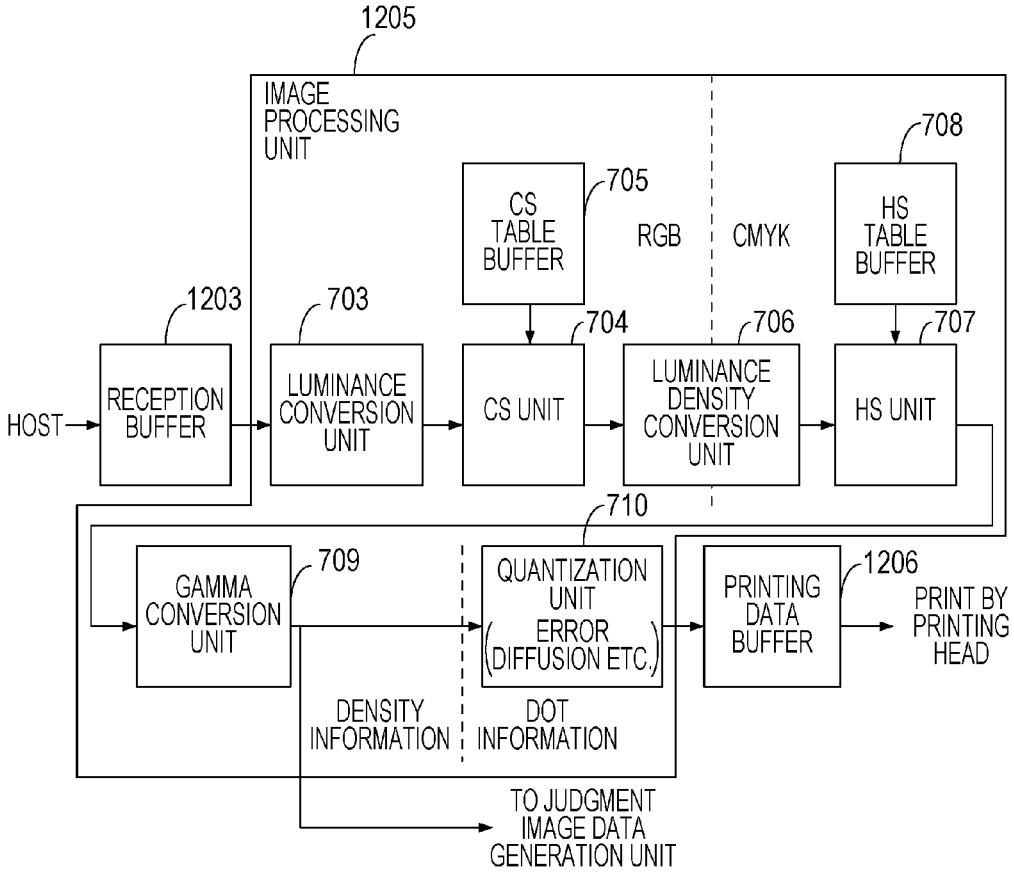
FIG. 7 is a diagram illustrating a data flow of a printing unit.

FIG. 7 is a diagram illustrating the image process described with reference to the flowchart of FIG. 6 and FIG. 12, and mainly illustrating the processes in step S602, step S603, and step S604. First, the host PC 1201 supplies input image data to the reception buffer 1203. The input image data received by the reception buffer 1203 may have a format of JPEG, PDF, or the like. In this embodiment, RGB data having three elements, that is, R, G, and B, obtained after the data of such a format is rasterized is received as an input image. The input image data has a resolution of 1200 dpi in the X direction and a resolution of 1200 dpi in the Y direction.

The image processing unit 1205 reads the RGB input image data from the reception buffer 1203 and converts the RGB input image data into RGB data corresponding to a color space of a printer using a luminance conversion unit 703. This conversion is referred to as "color space conversion". Next, a CS unit 704 reads a correction parameter from a color shading table buffer 705 and performs correction so that color unevenness is not generated. This correction is referred to as a "color shading process". The color shading process is a method for performing a correction process in three dimensions of R, G, and B so that color unevenness is not generated even when a tint of a secondary color is changed as a result of increase or decrease of an ejection amount by the head shading. As with the case of the head shading, a unit of a plurality of nozzles in the Y direction in which the nozzles are arranged is used as a unit of processing and a correction parameter is provided in advance for each unit of processing. The number of nozzles in the unit of processing may be the same as that in the head shading or may be different from that in the head shading.

The image data which has been subjected to the color shading process is converted from the RGB data into data suitable for ink colors used for printing of an image by a luminance density conversion unit 706. In this embodiment, the RGB data is converted into CMYK data including four elements, that is, C, M, Y, and K since four color inks of C, M, Y, and K are used. Thereafter, the HS processing unit 707 reads a correction parameter from a head shading table buffer 708 and performs the head shading process. The head shading process is performed for each ink color and a single correction parameter is employed for a plurality of nozzles as described above.

Subsequently, a gamma conversion unit 709 performs gamma conversion. Next, a quantization unit 710 performs a quantization process of converting density data of C, M, Y, and K into data representing the number of ink dots ejected for printing. Quantization data obtained by the quantization is stored in the printing data buffer 1206. The generated quantization data has a resolution of 1200 dpi in the X direction and a resolution of 1200 dpi in the Y direction. Data developed as index data representing printing or non-printing of ink dots based on the quantization data is read from the printing data buffer 1206 in response to a print timing signal, not illustrated, and the data is transmitted to the printing unit 101 which prints an image. As a result, a printing resolution of the printed image is 1200 dpi in the X direction in which the printing medium is conveyed and 1200 dpi in the Y direction in which the nozzles are arranged. Note that the printing resolution in the Y direction is the same as nozzle arrangement density of the printing heads 102.

Process of Generating Judgment Reference Image Data

Figure 8:
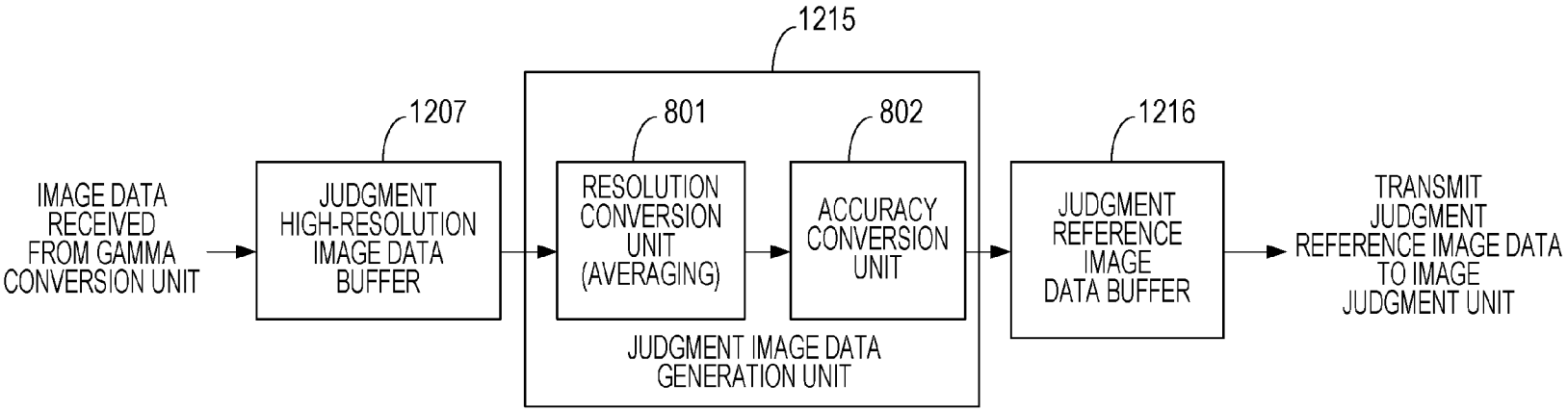
FIG. 8 is a diagram illustrating generation of judgment image data.

Next, a process of generating judgment reference image data, that is, the processes in step S605 and step S606, will be mainly described in detail with reference to FIG. 8. The image processing unit 1205 transmits image data which has been processed by the gamma conversion unit 709 and which has not been subjected to the quantization process to the judgment image data generation unit 1215 in parallel to the data process performed on the image to be printed. This image data corresponds to RGB input image data immediately before being converted into dot ejection number data. The image data which has been processed by the gamma conversion unit 709 represents final density information obtained after the image process and has a resolution of 1200 dpi in the X direction and a resolution of 1200 dpi in the Y direction. The judgment image data generation unit 1215 includes a resolution conversion unit 801 and an accuracy conversion unit 802.

First, the judgment image data generation unit 1215 receives the image data which has been subjected to the various image processes from the gamma conversion unit 709 and stores the image data in the judgment high-resolution image data buffer 1207. The judgment high-resolution image data buffer 1207 may not be required if arrangement of image data transmitted from the gamma conversion unit 709 corresponds to a direction which intersects with the nozzle arrangement direction of pixels in the printed image (X direction). When the arrangement of the image data corresponds to the Y direction, the data is stored in the judgment high-resolution image data buffer 1207, and a process of sorting the data is required to be performed when the data is read so that the data is arranged in the X direction. In this embodiment, the judgment high-resolution image data buffer 1207 receives the data once.

Then the judgment image data generation unit 1215 reads the image data from the judgment high-resolution image data buffer 1207 in an order required for a process performed by the resolution conversion unit 801 and performs a resolution lowering process. In this embodiment, a resolution in the conveying direction (X direction) of the printing medium is converted from 1200 dpi to 300 dpi.

Subsequently, the accuracy conversion unit 802 performs a process of lowering bit accuracy of the image data to accuracy capable of detecting color unevenness. Although the image data transmitted from the host PC 1201 has R of 8 bits, G of 8 bits, and B of 8 bits (256 gradation levels), the number of gradation levels is reduced to 6 bits (64 gradation levels). By this, reduction of a processing load, reduction of a memory band, and reduction of a data amount at a time when the judgment reference image data and the reading data are compared with each other may be realized.

The judgment reference image data generated by the processes performed by the resolution conversion unit 801 and the accuracy conversion unit 802 is stored in the judgment reference image data buffer 1216. The judgment reference image data buffer 1216 may not be required for the same reason as the judgment high-resolution image data buffer 1207. When an order of the judgment reference image data is different from a pixel order determined by the image judgment unit 1217, the judgment reference image data is required to be stored once in the judgment reference image data buffer 1216. Thereafter, the judgment reference image data is transmitted to the image judgment unit 1217.

Figure 5:
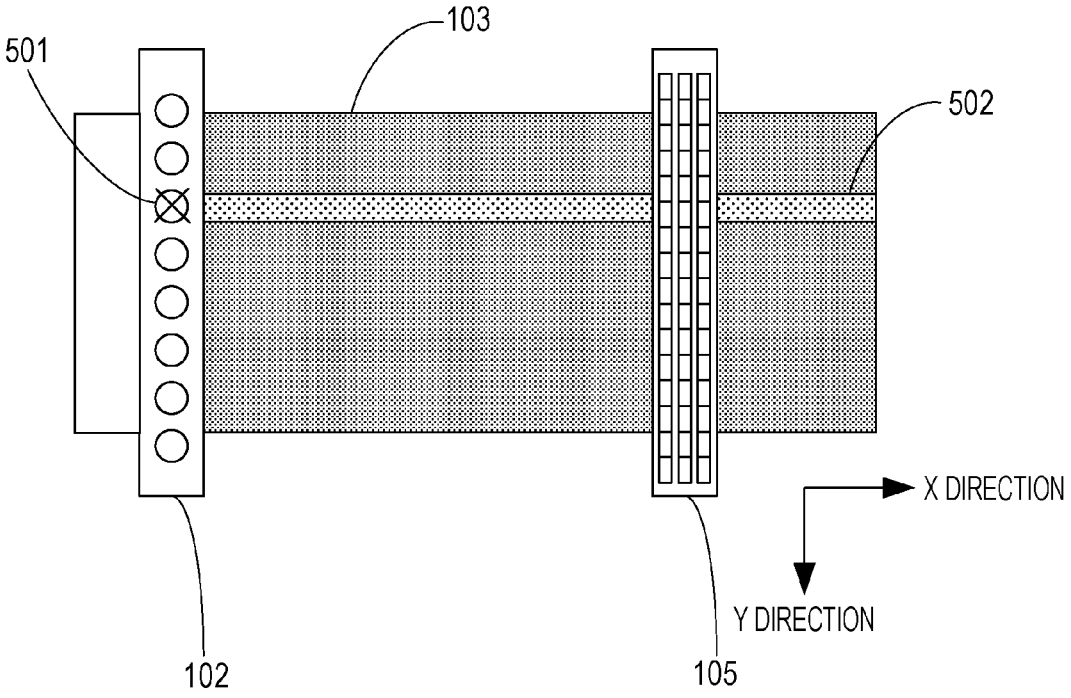
FIG. 5 is a diagram illustrating color unevenness in a streak form caused by defective ejection of the nozzles.

Here, the resolution conversion process performed on the judgment reference image data which is a characteristic configuration of this embodiment will be described with reference to FIG. 5. When a nozzle 501 included in the printing heads 102 is defective, a color unevenness portion 502 in a streak form is continuously generated in the conveying direction in a printed image. To determine whether the color unevenness is generated, a judgment resolution in the X direction may be lower than a printing resolution. Accordingly, in this embodiment, resolution conversion is performed such that resolutions in the X direction of two data items used for a judgment process become 300 dpi which is lower than the printing resolution.

Figure 9A:
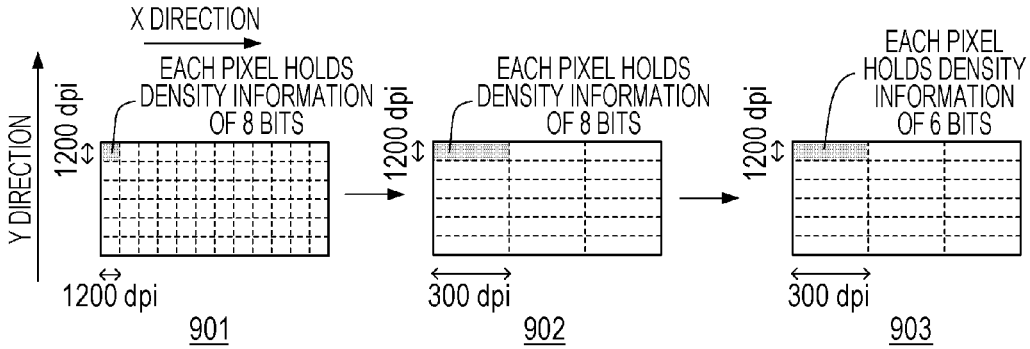
FIGS. 9A to 9C are diagrams illustrating a method for generating judgment image data.

FIG. 9A is a diagram schematically illustrating a method for generating the judgment reference image data. Image data 901 supplied from the gamma conversion unit 709 is continued in the Y direction in FIG. 9A, and pixels are arranged in an order in which a pixel in an end of the Y direction is followed by a leading pixel in a next column in the X direction including pixels continued in the Y direction. The image data is CMYK data having a resolution of 1200 dpi in the Y direction and a resolution of 1200 dpi in the X direction, and each pixel has 8 bits, that is, 256 gradation levels. In this image data, the resolution conversion unit 801 adds values of four pixels consecutively arranged in the X direction to one another and performs averaging so that the resolution lowering process is performed. Consequently, image data 902 of 8 bits having a resolution of 300 dpi in the X direction and a resolution of 1200 dpi in the Y direction is generated. Furthermore, the accuracy conversion unit 802 performs accuracy conversion such that the image data 902 including pixels of 8 bits is converted into image data including pixels of 6 bits so as to generate judgment reference image data 903.

Figure 9B:
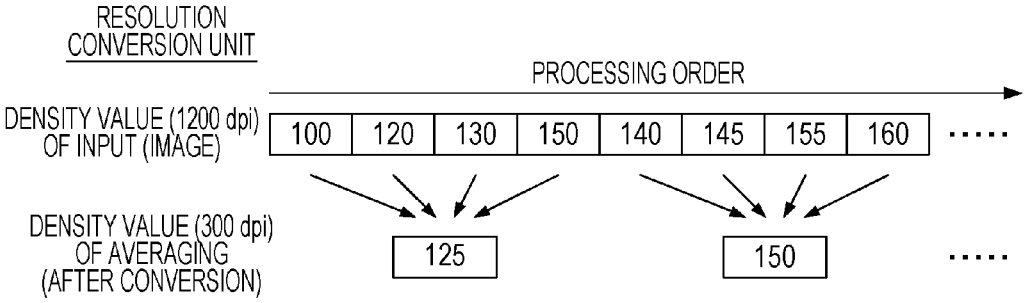

FIG. 9B is a diagram illustrating the resolution conversion process performed by the resolution conversion unit 801. The resolution conversion unit 801 successively receives data items which are consecutively arranged in the X direction in a unit of four pixels. In an example of FIG. 9B, four pixels 100, 120, 130, and 150 representing density information are averaged so that density information 125 is obtained. Subsequently, four pixels 140, 145, 155, and 160 representing density information are averaged so that density information 150 is obtained. In this way, by calculating an average value, density information in a unit of 300 dpi may be obtained.

Figure 9C:
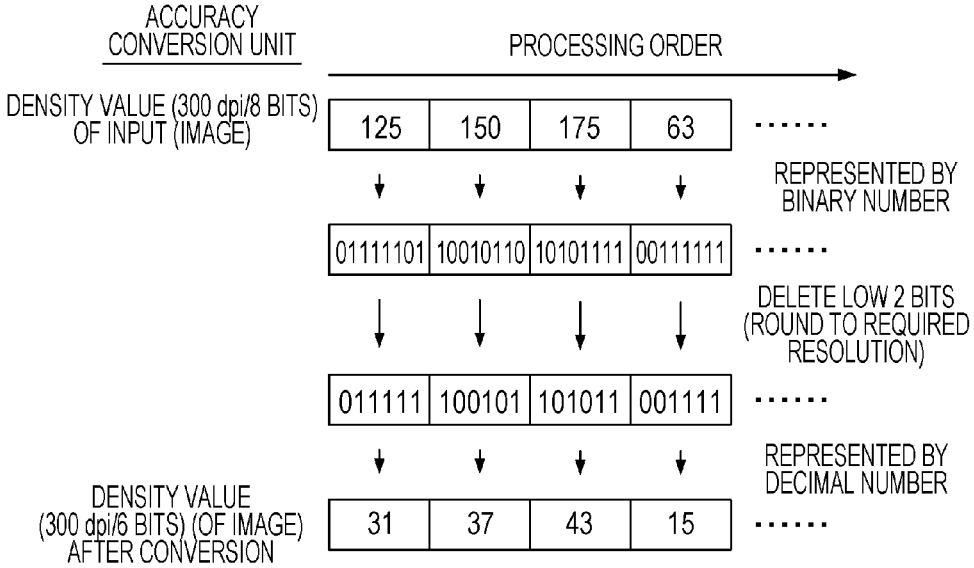

FIG. 9C is a diagram illustrating the conversion process performed by the accuracy conversion unit 802. The accuracy conversion unit 802 receives pixel data having a resolution of 300 dpi which is obtained through the resolution conversion and deletes low 2 bits in pixel data 125, 150, 175, and 63 of 8 bits representing density information. As a result, density information 31, density information 37, density information 43, and density information 15 of 6 bits having a resolution of 300 dpi are obtained.

Process of Reading Unit

Figure 10:
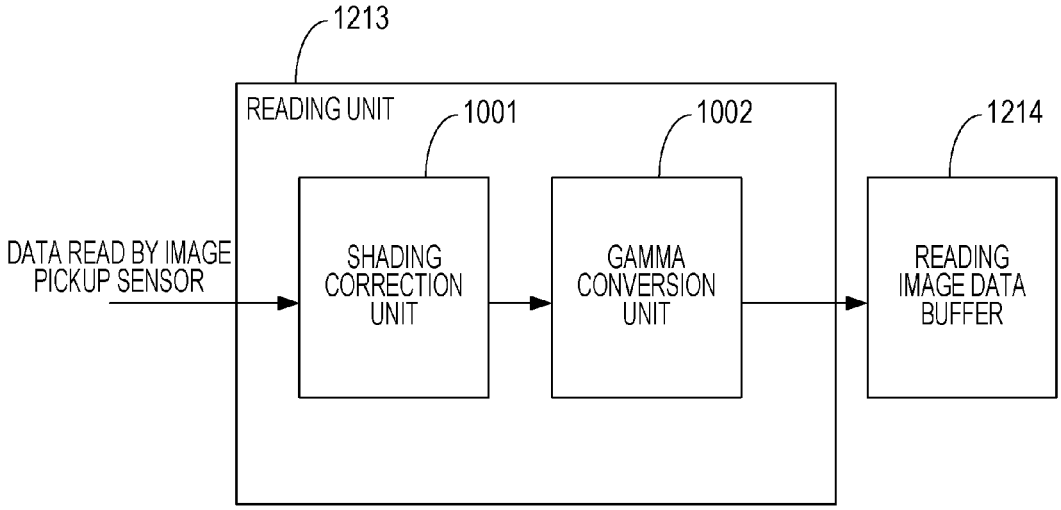
FIG. 10 is a diagram illustrating a data flow of a reading unit.

FIG. 10 is a diagram illustrating a process performed by the reading unit 1213. The reading unit 1213 receives data read by the sensor 105 in synchronization with the conveying speed of the printing medium on which image data is printed. In this embodiment, the reading unit 1213 receives data read with a resolution of 1200 dpi in the X and Y directions. A shading correction unit 1001 performs correction on luminance unevenness caused by a characteristic of an image pickup system so that an image has uniform brightness. Subsequently, a gamma conversion unit 1002 performs correction so that a color space of the sensor 105 becomes the same as the color space of the printer. Then corrected RGB reading data is stored in the reading image data buffer 1214.

Judgment Process Using Judgment Reference Image and Reading Image

Figure 11:
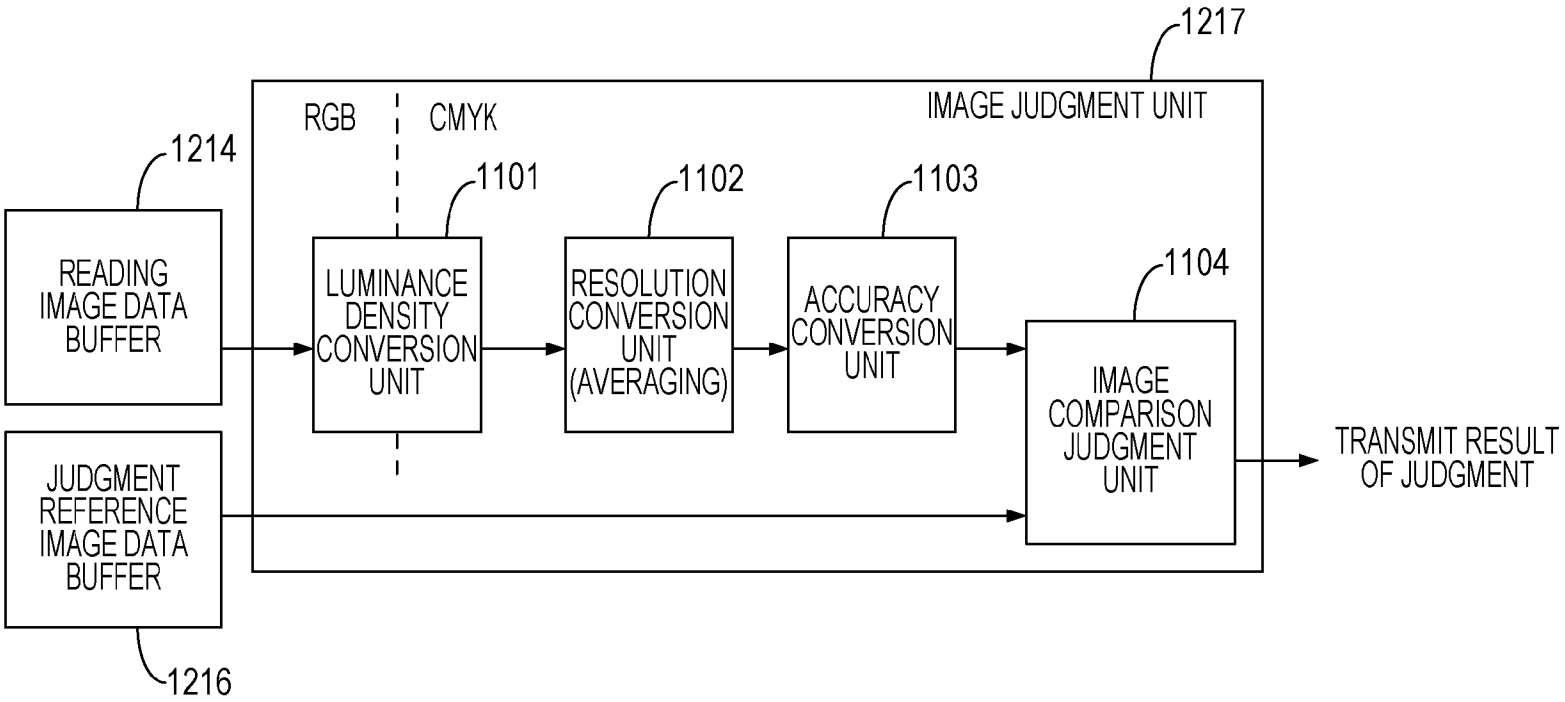
FIG. 11 is a diagram illustrating a data flow of an image judgment unit.

FIG. 11 is a diagram illustrating a process performed by the image judgment unit 1217. Reading data which is read by the sensor 105 and which has been subjected to the various processes by the reading unit 1213 is stored in the reading image data buffer 1214. The judgment reference image data generated by the judgment image data generation unit 1215 is stored in the judgment reference image data buffer 1216. The reading data stored in the reading image data buffer 1214 is RGB data having a resolution of 1200 dpi in the X direction and a resolution of 1200 dpi in the Y direction. On the other hand, the judgment reference image data stored in the judgment reference image data buffer 1216 is CMYK data having a resolution of 300 dpi in the X direction and a resolution of 1200 dpi in the Y direction. Therefore, the same image format is required to be assigned to the reading data and the judgment reference image data. Accordingly, the reading data is converted into CMYK data by a luminance density conversion unit 1101 included in the image judgment unit 1217, and in addition, the resolution conversion process is performed by a resolution conversion unit 1102, and furthermore, the accuracy conversion process is performed by an accuracy conversion unit 1103 similarly to the processes described with reference to FIG. 8 and FIGS. 9A to 9C. Then an image comparison judgment unit 1104 compares the judgment reference image data with the reading image data which has been subjected to the various conversion processes so as to determine whether color unevenness is generated. The image comparison judgment unit 1104 transmits a result of the judgment to the CPU 1218 which controls the entire printing apparatus. By this, when it is determined that color unevenness is generated, the CPU 1218 may stop a printing operation or continues printing after changing a correction parameter to be used in a correction process in accordance with the result of the examination of the printed actual image. Furthermore, the CPU 1218 may notify a user of information representing an image in which color unevenness may be generated using a notification unit, not illustrated, or information for prompting execution of a process of regenerating a correction parameter. When the printing is continued, the correction parameter is changed in accordance with a result of the comparison between the judgment reference image data and the reading data and a correction process is performed on an image to be printed after the read actual image using the changed correction parameter.

An example of a method for comparing the judgment reference image data with the reading image data and an example of a method for determining whether color unevenness is generated in accordance with a result of the comparison which are employed in the image comparison judgment unit 1104 will be described below. A difference between a pixel value of a target pixel of the reading data and a pixel value of a pixel of the judgment reference image data corresponding to the target pixel of the reading data is obtained, and in this way, difference values of all pixels included in a unit of processing for a judgment process, such as a unit of image, a unit of page, or the like, are obtained. In this embodiment, the judgment reference image data and the reading image data are both CMYK data of 6 bits, and differences in C, M, Y, and K are obtained. Thereafter, the obtained difference values are compared with predetermined threshold values. The judgment as to whether color unevenness is included in the printed image is made in accordance with results of the comparisons. Here, one of judgment methods below may be employed. For example, it is determined that color unevenness is generated if at least one of all the pixels included in the unit of processing for the judgment process has a difference value which exceeds a threshold value. Alternatively, it is determined that color unevenness is generated if a predetermined number of pixels have difference values which exceed respective threshold values.

Furthermore, one image may be more finely divided so that a smaller unit for the judgment process is obtained. For example, pixel arrays for one raster which are consecutively arranged in the X direction are set as a unit of processing for the judgment process, and if the number of pixels having difference values which exceed respective threshold values is equal to or larger than 1 or equal to or larger than a predetermined number in the pixel arrays for one raster, it is determined that color unevenness is included in the printed image. Alternatively, if at least a predetermined number of pixels having difference values which exceed respective threshold values are consecutively included in the pixel arrays for one raster, it may be determined that color unevenness is included in the printed image. In this way, information on a position where color unevenness is generated may be obtained by performing the judgment process for each raster including pixels which are consecutively arranged in the X direction. By this, by performing the correction parameter generation process after the judgment process, a processing load may be reduced such that a region in which a pattern is printed or measured is limited only to a position in which it is determined that color unevenness is generated or a proximal region of the position. Furthermore, since the judgment is performed for individual ink colors of C, M, Y, and K, a correction parameter is regenerated only for an ink color corresponding to the color unevenness, and accordingly, a processing load may be reduced when compared with a case where pattern printing and pattern measurement are performed for individual ink colors.

Furthermore, the reading image data buffer 1214 may not be required for the same reason as the judgment high-resolution image data buffer 1207. When color unevenness which is continued in the conveying direction (X direction in the drawings), such as a streak caused by defective ejection of the nozzles, is to be detected, image data items are stored in the reading image data buffer 1214 in a consecutive manner in the Y direction so that the resolution lowering processing is performed in the X direction. The data items may be consecutively read in the X direction if the data items are read after performing offset, and accordingly, high-speed processing and reduction of a memory band may be realized.

Although the printed image is read by the sensor 105 in a resolution of 1200 dpi in the X direction which is the same as a printing resolution and the resolution of 1200 dpi is converted into a resolution of 300 dpi by the resolution conversion unit 1102 of the image judgment unit 1217 in this embodiment, the present disclosure is not limited to this. The reading may be performed with a lower resolution as long as the sensor 105 is capable of performing reading with a resolution lower than the printing resolution. When the reading is performed with a low resolution, the conveying speed of the printing medium may be increased, and accordingly, throughput of the printing apparatus may be improved. Note that, in a case where the reading resolution is the same as the resolution of the judgment reference image data used for the judgment process, that is, the sensor 105 reads data in a reading resolution of 300 dpi in the X direction and a reading resolution of 1200 dpi in the Y direction, the resolution lowering process of the image judgment unit 1217 is not required.

For example, a comparison method in a case where data is read while a resolution in the X direction is lowered to 40 dpi for realizing a high speed process will be described with reference to FIG. 14.

A flow until a detection of occurrence of ink non-ejection will be described taking a case where the ink non-ejection of a C ink occurs in a target printed material 1401 corresponding to input image data 901 as an example.

First, judgment reference image data 903 is generated from the input image data 901. Here, the judgment reference image data 903 has an RGB three-color data format, a resolution of 1200 dpi in the Y direction, and a resolution of 40 dpi in the X direction.

Furthermore, reading data 1402 is obtained by reading the printed material 1401 to be examined in the RGB three-color data format and with the resolution of 1200 dpi in the Y direction and the resolution of 40 dpi in the X direction.

The judgment reference image data 903 and the reading data 1402 are compared with each other so that a difference is extracted. In this way, an uneven pixel 1405 is specified.

Figure 14:
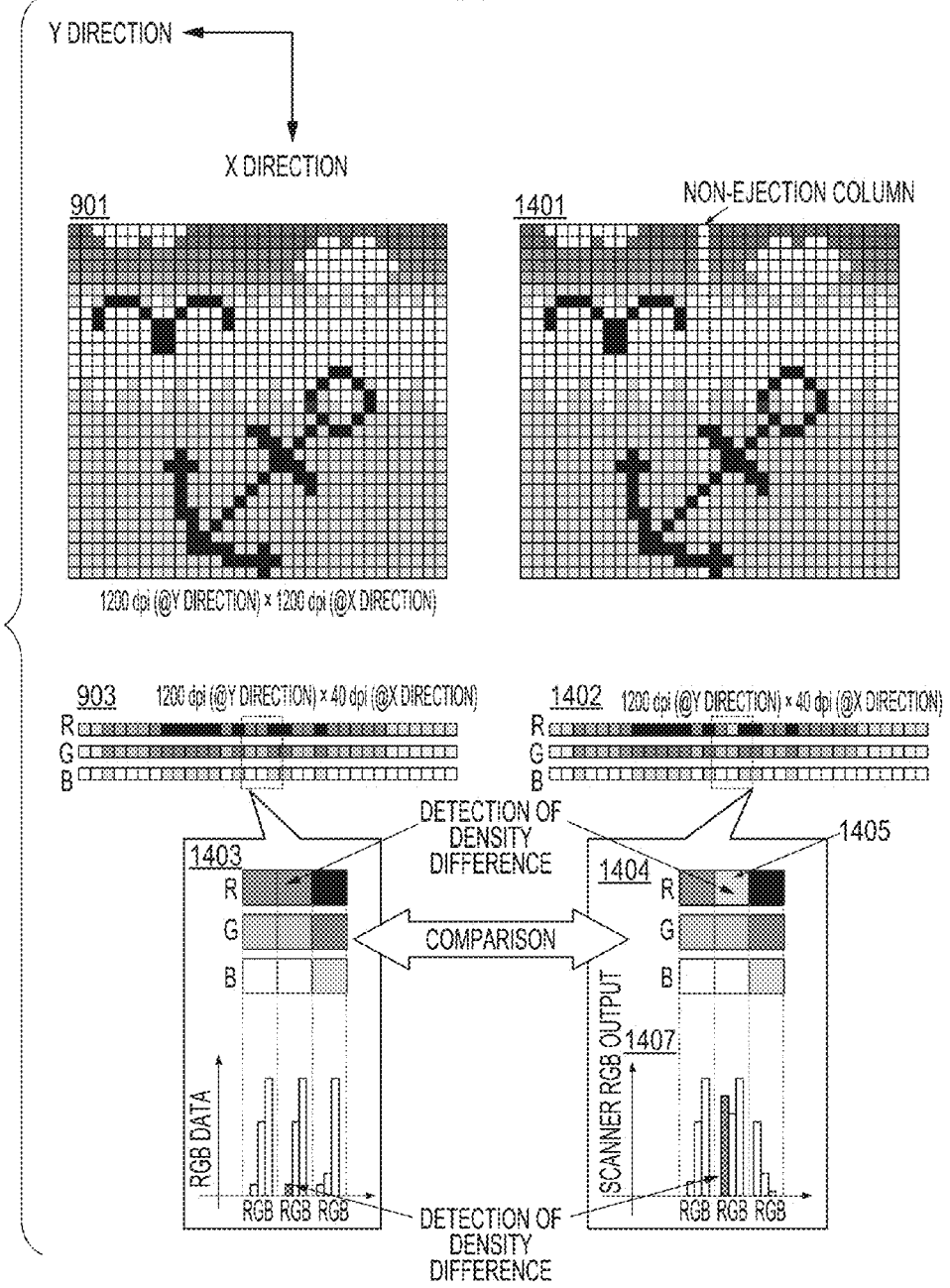
FIG. 14 is a diagram illustrating image judgment.

In FIG. 14, an enlarged view 1404 of an uneven portion of the reading data 1402, a graph 1407 corresponding to scanner RGB output, an enlarged view 1403 of a specific portion of the judgment reference image data 903 corresponding to the uneven portion of the reading data 1402, and a graph corresponding to RGB data are illustrated in a visually recognizable manner.

When the graph corresponding to RGB data and the graph 1407 are compared with each other, a portion in which a value of an R channel is considerably different from a reference value is detected, and the portion may be specified as the uneven pixel 1405. Furthermore, since an output of the R channel is remarkably changed, it is estimated that an error occurs in the C ink which is a complementary color of the R ink.

In accordance with this result, an examination pattern for specifying a cause of a defect in detail may be printed so that detailed examination is performed and correction may be performed on printing to be subsequently performed based on the uneven pixel 1405.

As described above, according to this embodiment, the judgment reference image data and the reading data are generated with a resolution in the conveying direction lower than the printing resolution in accordance with the input image data and the image data obtained by reading the printed image, and a color unevenness judgment is performed. With this configuration, a processing load and an amount of data transfer at a time of the judgment process may be reduced and high-speed processing is realized, and accordingly, an image judgment in the entire system may be performed at high speed. Furthermore, since the reading resolution used when the sensor 105 reads the printed image is lower than the printing resolution, the printing medium may be conveyed at high speed and reduction of a processing load of the reading data and reduction of a data amount may be realized.

Furthermore, since color unevenness is determined using image data of an actual image which is not a maintenance pattern dedicated for a judgment of color unevenness and reading data of the printed image, consumption of the ink and the printing medium for printing the dedicated pattern may be reduced, and accordingly, running cost may be reduced.

Note that, in this embodiment, since the resolution in the direction in which the printing medium is conveyed, that is, the X direction, is lower than the printing resolution for printing the image, high-speed processing is realized without degrading accuracy of detection of color unevenness in a streak form. Furthermore, another resolution lowering process may be additionally performed on the two data items used in the judgment process so that the resolution in the direction in which the nozzles are arranged, that is, the Y direction, becomes lower than the resolution corresponding to pitch of nozzle arrangement in Y direction. By this, color unevenness generated due to a plurality of causes may be detected at high speed and at high accuracy when the image is read.

Other Embodiment

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

Furthermore, the present disclosure may be realized by a process of supplying a program which realizes at least one of the functions of the foregoing embodiment to a system or an apparatus through a network or a storage medium and reading and executing the program using at least one processor included in a computer of the system or the apparatus. Furthermore, the present disclosure may be realized by a circuit which realizes at least one of the functions (ASIC, for example).

By the method described above, a color deviation may be detected based on image data and reading image data with a comparatively low processing load. Furthermore, high-speed processing and reduction of an amount of data transfer may be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-157087, filed Jul. 31, 2014, which is hereby incorporated by reference herein in its entirety.

What is claimed is:

1. An image processing apparatus which examines an image printed, by printing heads having a plurality of nozzles which eject ink and which are arranged in a first direction, on a printing medium which is conveyed in a second direction which intersects with the first direction, the image processing apparatus comprising:

a generation unit configured to generate judgment image data including R, G, and B elements, used for inspection of a printed image printed with a first resolution in the second direction, the judgment image data having a second resolution in the second direction which is lower than the first resolution, based on data on the image, wherein the generation unit is configured to generate the judgment image data by performing a resolution lowering process on the data on the image; and an inspection unit configured to inspect the image by comparing, with the second resolution, each of R, G, and B elements of the judgment image data with R, G, and B elements of read data respectively, the read data being obtained by reading the image printed with the first resolution in the second direction based on the data on the image, and to detect an error in a nozzle for ink having complementary color of one element of the R, G, and B elements based on a difference between a value of the one element of the judgment image data and a value of the one element of the read data.

2. The image processing apparatus according to claim 1, further comprising:

a printing unit configured to print an image on the printing medium using the printing heads with the first resolution in the second direction.

3. The image processing apparatus according to claim 1, wherein the reading data is obtained by reading the image with a reading resolution higher than the second resolution in the second direction, and the inspection unit converts the resolution in the second direction of the data obtained by reading the image into the second resolution.

4. The image processing apparatus according to claim 1, further comprising:

a sensor configured to read the image.

5. The image processing apparatus according to claim 1, further comprising:

a notification unit configured to notify a user of information on a result of the inspection performed by the inspection unit.

6. The image processing apparatus according to claim 1, wherein the number of gradation levels of the judgment image data generated by the generation unit is smaller than the number of gradation levels of the input image data.

7. The image processing apparatus according to claim 1, wherein the plurality of nozzles are aligned at first alignment pitches in the first direction, and further comprising a correction unit configured to generate a correction parameter used for correcting the image data for controlling the numbers of ink dots formed by the nozzles based on read data which represents an image having a resolution in the first direction equal to the second resolution and is acquired by reading the printed image printed on the printing medium.

8. An image processing method for inspecting an image printed, by printing heads having a plurality of nozzles which eject ink and which are arranged in a first direction, on a printing medium which is conveyed in a second direction which intersects with the first direction, the image processing method comprising:

generating judgment image data including R, G, and B elements, used for inspection of a printed image printed with a first resolution in the second direction, the judgment image data having a second resolution in the second direction which is lower than the first resolution, based on data on the image, wherein the generating the judgment image data includes performing a resolution lowering process on the data on the image; and inspecting the image by comparing, with the second resolution, each of R, G, and B elements of the judgment image data with R, G, and B elements of read data respectively, the read data being obtained by reading the image printed with the first resolution in the second direction based on the data on the image, and detecting an error in a nozzle for ink having complementary color of one element of the R, G, and B elements based on a difference between a value of the one element of the judgment image data and a value of the one element of the read data.

9. The image processing method according to claim 8, further comprising:

printing an image on the printing medium using the printing heads with the first resolution in the second direction.

10. The image processing method according to claim 8, wherein the reading data is obtained by reading the image with a reading resolution higher than the second resolution in the second direction, and the inspecting comprises converting the resolution in the second direction of the data obtained by reading the image into the second resolution.

11. The image processing method according to claim 8, further comprising:

using a sensor to read the image.

12. The image processing method according to claim 8, further comprising:

notifying a user of information on a result of the inspection performed in the inspecting step.

13. The image processing method according to claim 8, wherein the number of gradation levels of the judgment image data generated in the generating step is smaller than the number of gradation levels of the input image data.

14. The image processing method according to claim 8, wherein the plurality of nozzles are aligned at first alignment pitches in the first direction, and further comprising generating a correction parameter used for correcting the image data for controlling the numbers of ink dots formed by the nozzles based on read data which represents an image having a resolution in the first direction equal to the second resolution and is acquired by reading the printed image printed on the printing medium.

15. A non-transitory computer-readable medium storing a program that causes a computer to execute an image processing method for inspecting an image printed, by printing heads having a plurality of nozzles which eject ink and which are arranged in a first direction, on a printing medium which is conveyed in a second direction which intersects with the first direction, the image processing method comprising:

generating judgment image data including R, G, and B elements, used for inspection of a printed image printed with a first resolution in the second direction, the judgment image data having a second resolution in the second direction which is lower than the first resolution, based on data on the image, wherein the generating the judgment image data includes performing a resolution lowering process on the data on the image; and inspecting the image by comparing, with the second resolution, each of R, G, and B elements of the judgment image data with R, G, and B elements of read data respectively, the read data being obtained by reading the image printed with the first resolution in the second direction based on the data on the image, and detecting an error in a nozzle for ink having complementary color of one element of the R, G, and B elements based on a difference between a value of the one element of the judgment image data and a value of the one element of the read data.

16. The non-transitory computer-readable medium according to claim 15, wherein the plurality of nozzles are aligned at first alignment pitches in the first direction, and further comprising generating a correction parameter used for correcting the image data for controlling the numbers of ink dots formed by the nozzles based on read data which represents an image having a resolution in the first direction equal to the second resolution and is acquired by reading the printed image printed on the printing medium.

* * * * *